United States Patent [19]

Poppenheimer

[11] Patent Number: 4,768,139

[45] Date of Patent: Aug. 30, 1988

[54] LIGHTING FIXTURE

[75] Inventor: Charles B. Poppenheimer, LaCanada, Calif.

[73] Assignee: GTY Industries, Sylmar, Calif.

[21] Appl. No.: 42,762

[22] Filed: Apr. 27, 1987

[51] Int. Cl.[4] ..... F21V 7/00

[52] U.S. Cl. ..... 362/302; 362/368; 362/431; 248/530; 439/426

[58] Field of Search ..... 362/431, 368, 302, 303; 248/545, 530, 156; 439/391, 395, 426

[56] References Cited

U.S. PATENT DOCUMENTS

| | | | |
|---|---|---|---|
| 1,757,975 | 5/1930 | Perkins | 362/337 |
| 3,876,970 | 4/1975 | Schweitzer | 248/156 |
| 4,499,527 | 2/1985 | Tanber et al. | 362/431 |
| 4,521,836 | 6/1985 | Puttemanns et al. | 362/431 |
| 4,523,263 | 6/1985 | Poyer | 362/431 |

OTHER PUBLICATIONS

Lunalite brochure, 5/1986, 4 pages.

*Primary Examiner*—Charles J. Myhre
*Assistant Examiner*—David A. Okonsky
*Attorney, Agent, or Firm*—Lyon & Lyon

[57] ABSTRACT

A lighting fixture includes a ground stake having a channel-like cross section, a lamp socket mounted to the stake, a lamp element engaged to the socket, and a power cable connected to the socket and extending within the channel of the stake. The lamp socket has spike contacts within lamp cores which pierce the narrow edges of the power cable to provide electrical contact from the power cable conductors to the lamp element.

5 Claims, 3 Drawing Sheets

FIG. 3.
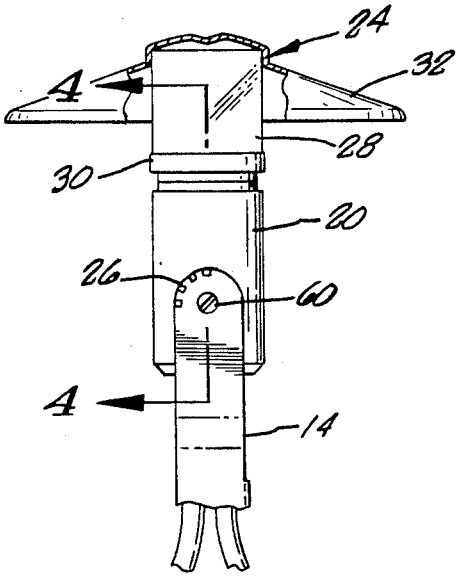
FIG. 4.
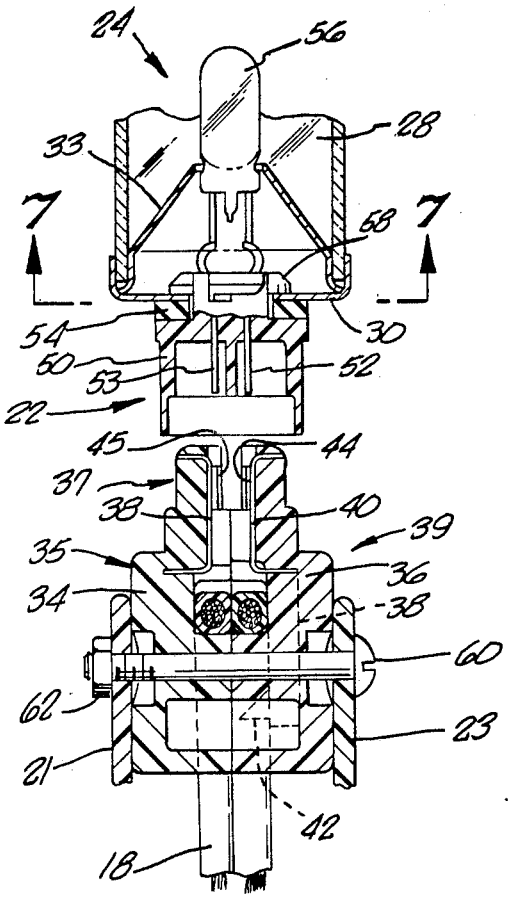
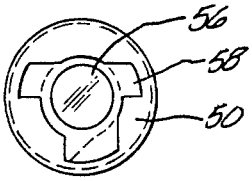
FIG. 9.
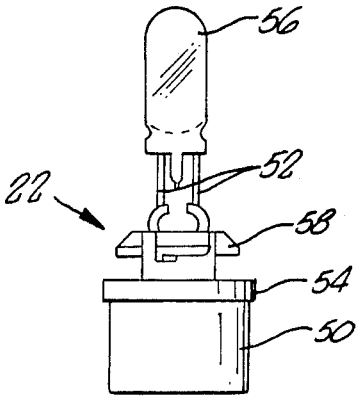
FIG. 8.
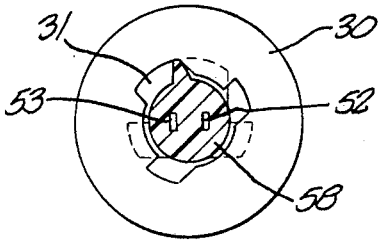
FIG. 7.

LIGHTING FIXTURE

BACKGROUND OF THE INVENTION

The field of the present invention is lighting fixtures. Outdoor lighting is often provided around gardens, yards, swimming pools, etc., with a low voltage lighting system. The system generally includes a step down transformer for reducing the 110 AC line voltage to 12 volts, a buried or surface power cable, and a number of lighting fixtures connected along the cable.

Existing fixtures typically involve one or more disadvantages. Fixtures made of plastic or corrosive metal have a limited life in outdoor use. In addition, they are often constructed so that the power cable leaves the ground, loops outside the fixture into one side of the lamp compartment, and then out of the other side and back to the ground. This configuration results in an aesthetically displeasing appearance due to the very visible power cable. Moreover, lighting fixtures made out of plastic materials must use very low wattage incandescent lamps, due to temperature limitations on the plastic material, and thus these fixtures put out very little light.

Furthermore, in some existing fixtures, electrical contact with the conductors in a rectangular cable is made by driving two sharp spikes into the wide sides of the cable. These spikes enter the cable from the wide edges and are staggered as they enter their respective conductor. While this configuration is simple in concept, proper electrical contact often is not made due to variations in the dimensions of the cable, and misalignment of the cable in relation to the spikes. In addition, outdoor lighting fixtures for home use often involve many parts and fasteners making assembly by an unskilled homeowner difficult.

SUMMARY OF THE INVENTION

The invention is directed to outdoor lighting fixtures which may be easily assembled, reliably installed, and which present an aesthetic appearance. To this end, a first aspect of the present invention includes a lamp socket mounted to a ground stake. The stake may include provision for receiving a power cable along its length extending to the socket.

In a further aspect of the present invention, the lamp socket may include a U-shaped passage to receive the power cable. Contact may be made in such a passage with the conductors in the cable. The passage may be substantially rectangular in cross section to aid in placement of the cable such that contact may be effected with the conductors from the narrow sides of the cable.

Accordingly, it is an object of the present invention to provide an improved outdoor lighting fixture. Other and further objects and advantages will appear hereinafter.

BRIEF DESCRIPTION OF THE DRAWINGS

In the drawings wherein similar reference characters denote similar elements throughout the several views:

FIG. 3 is a side perspective fragment view in part cross section of the fixture of FIG. 1;

FIG. 4 is an enlarged section view taken along line 4—4 of FIG. 3;

FIG. 7 is a section view taken along line 7—7 of FIG. 4;

FIG. 8 is a perspective view of the lamp element illustrated in FIG. 4;

FIG. 9 is a top view thereof;

DETAILED DESCRIPTION OF THE PREFERRED EMBODIMENT

Figure 1:
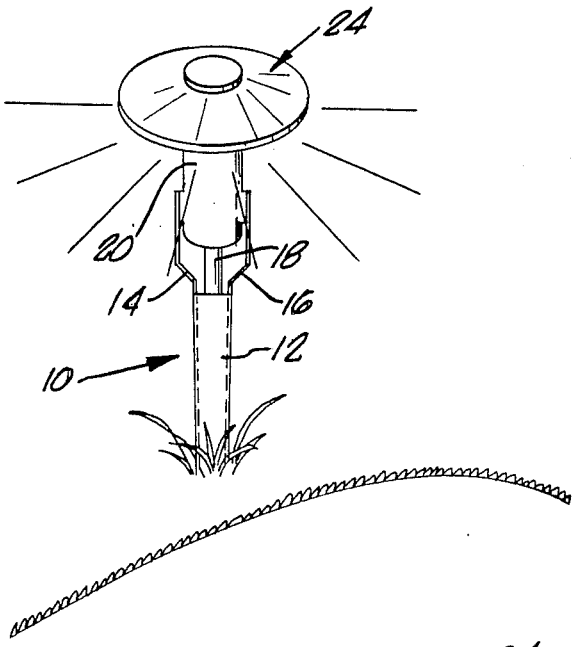
FIG. 1 is a perspective view of the lighting fixture of the invention.
Figure 2:
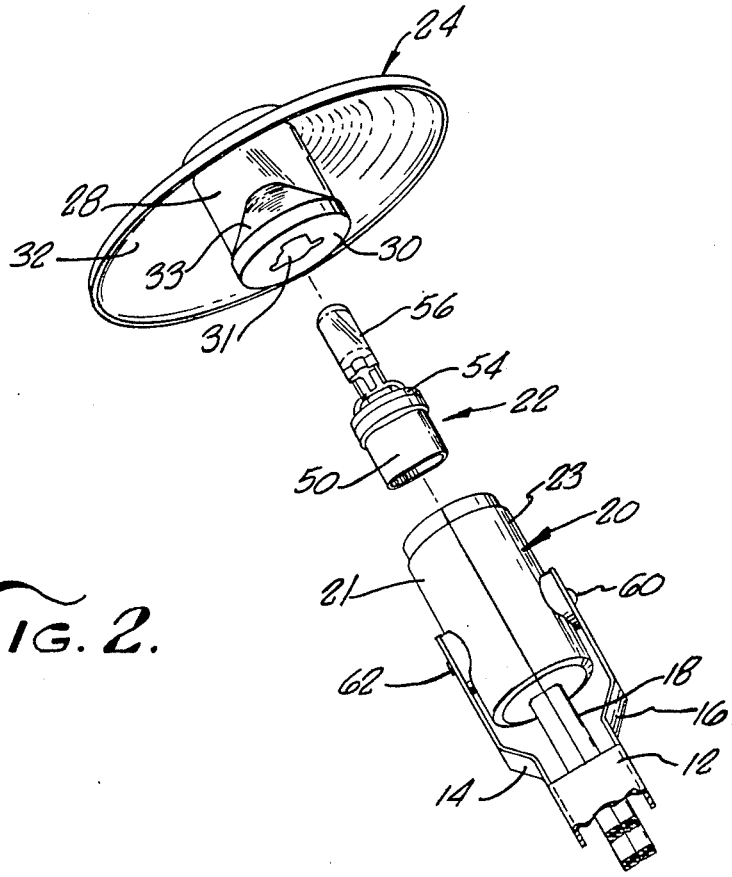
FIG. 2 is an exploded perspective fragment view of the fixture of FIG. 1.

Turning now in detail to the drawings, FIGS. 1 and 2 illustrate a lighting fixture generally designated by 10 having a ground stake 12 with one end thereof pressed into the ground. The ground stake 12 has a generally C-shaped or channel-like cross section and branches into two spaced apart mounting arms 14 and 16. A lamp socket 20 having covers 21 and 23 is pivotally secured in between the arms 14 and 16. A power cable 18 emerges from the ground and/or rises from the ground surface within the cross section of the ground stake 12, forms a loop within the lamp socket 20, and then returns to the ground within the ground stake 12. The power cord 18 may be provided with sufficient slack to allow the lamp socket 20 to pivot with respect to the ground stake 12. A spread light reflector assembly 24 is disposed on top of the lamp socket 20.

As shown in detail in FIG. 2, a lamp element 22 includes a sleeve 50 which is slideably engageable into an opening in the lamp socket 20. The reflector assembly 24 comprises a disc-like base 30 having a keyed cutout 31. A reflector cone 33 having a polished or reflective surface is disposed on top of the base 30. A cylindrical transparent lens 28 is positioned over the reflector cone 33 and is covered by a reflector cap 32. The reflector assembly 24 is mounted onto the lamp element 22 via the keyed cutout 31, such that the bulb 56 of the lamp element 22 is positioned within the lens 28 on top of the reflector cone 33, as described further hereinafter.

The lamp socket 20 is pivotally mounted between arms 14 and 16 with a screw 60. A detent mechanism 26 is provided so that the lamp socket 20 may be positioned at an angle with respect to the ground stake 12, as shown in FIGS. 2 and 3, to obtain a particular lighting effect.

As shown in FIG. 4, the lamp socket 20 includes semi-cylindrical first and second lamp cores 34 and 36 which each have a rounded outer surface and a planer inner surface. The cores are enclosed within a housing comprising socket covers 21 and 23. Cores 34 and 36 form a lamp holder 39 having a base 35 and a neck 37. The lamp cores 34 and 36 may be identical. Contacts 38 and 40 within each of the lamp cores 34 and 36 respectively extend from the neck 37 to the base 35 of the lamp holder 39.

Figure 5:
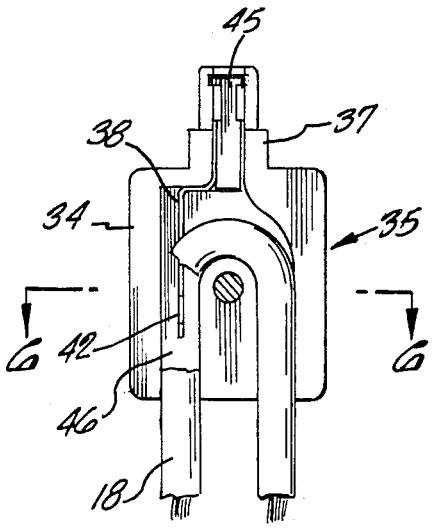
FIG. 5 is a perspective view in part section of the lamp socket of FIG. 4.
Figure 6:
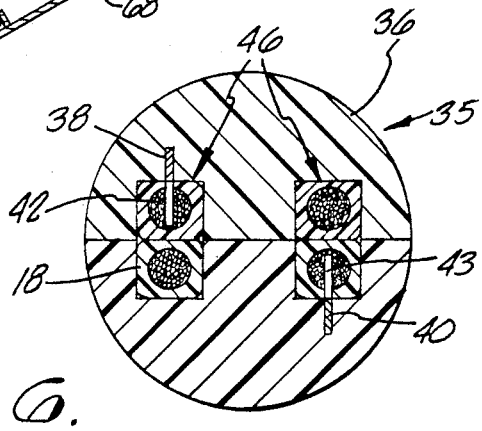
FIG. 6 is a section view taken along line 6—6 of FIG. 5.

With reference to FIGS. 5 and 6, the lamp holder 39 has a U-shaped passage 46 in the base 35 thereof, specifically in the cores 34 and 36. The U-shaped passage 46 has a rectangular cross section dimensioned to accommodate the power cable 18 which has a generally rectangular shape. Each of the contacts 38, 40 includes a spike 42, 43 respectively, protruding into the U-shaped passage 46. The spikes 42, 43 protrude into the passage 46 from the narrow sides thereof. In addition, the spikes are disposed on opposite sides of the passage 46 so that the spike 42 engages one of the conductors within the power cord 18, while the spike 43 engages the other conductor. The contacts 38, 40 have clips 44, 45 in the neck 37 of the lamp holder 39.

Referring once again to FIG. 4, the sleeve 50 of the lamp element 22 is dimensioned to slideably engage the neck 37 of the lamp holder 39. The lamp element 22 includes contact pins 52, 53 extending from the sleeve 50 through a boss 58 integrally joined to the sleeve 50 and into the bulb 56, to provide electrical contact therewith. A gasket 54 is disposed in between the sleeve 50 of the lamp element 22 and the base 30 of the reflector assembly 24 in order to seal the reflector assembly from the environment. The contact pins 52, 53 are aligned within the sleeve 50 such that when the sleeve is engaged to the neck 37 of the lamp holder 39 the pins 52, 53 will engage the clips 44, 45 of the contacts 38, 40, to provide electrical connection from the power cord 18 to the bulb 56.

The engagement of the reflector assembly 24 onto the lamp element 22 is further illustrated in detail in FIGS. 7–9. With reference to FIG. 7, the base 30 of the reflector assembly 24 has a keyed cutout 31 centrally located thereon. Correspondingly, the boss 58 in the lamp element 22 includes keys matching those on the base 30 as shown in FIGS. 8 and 9. The reflector assembly 24 is engaged to the lamp element 22 via the interaction of the boss 58 and keyed cutout 31 by engaging the reflector assembly 24 onto the lamp element 22 with sufficient force to compress the gasket 54, so that the base 30 may completely pass over the boss 58, and then be slightly rotated to prevent release.

Figure 10:
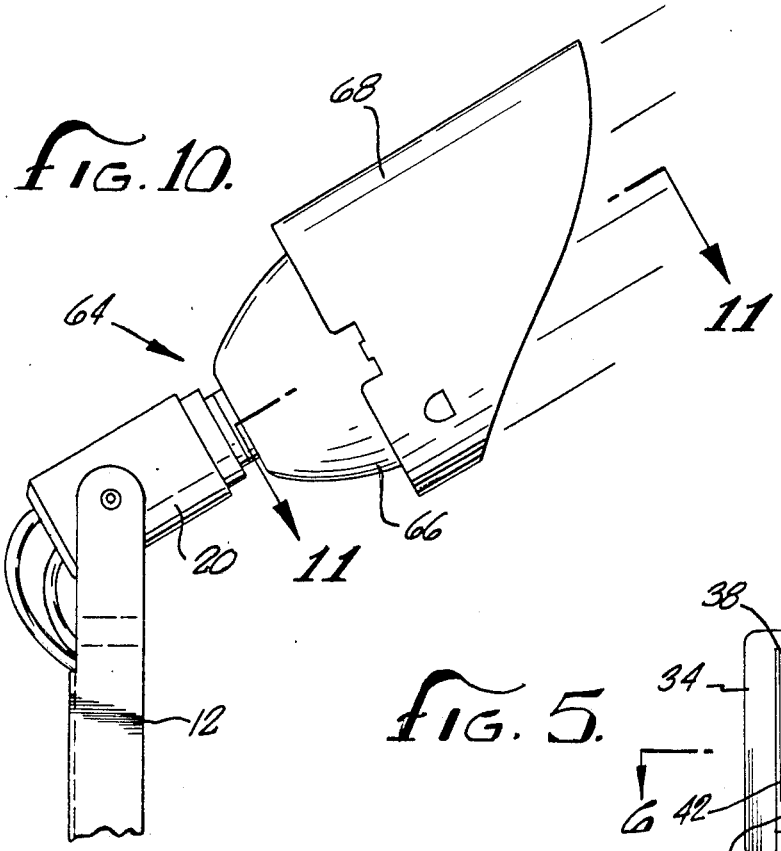
FIG. 10 is a perspective fragment view of a second embodiment of the lighting fixture of the present invention.
Figure 11:
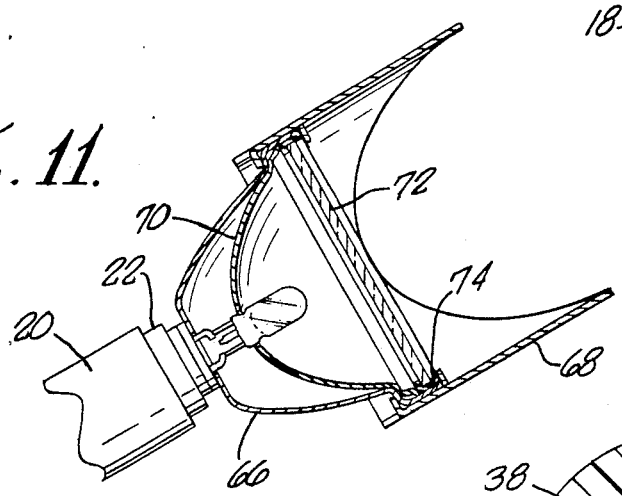
FIG. 11 is a section view taken along line 10—10 of FIG. 9.

FIGS. 10 and 11 illustrate the lighting fixture of the invention having a directional reflector assembly 64 for providing accent or spotlighting, with the other components of the lighting fixture being the same as those previously described in connection with the lighting fixture of FIG. 1. The directional reflector assembly 64 comprises an enclosure 66 (analogous to the base 30 of the reflector assembly 24) surrounding a reflector cup 70. A lens 72 covers the reflector cup 70 and is sealed along its perimeter to the enclosure 66 by a gasket 74. A shade 68 is pivotally mounted onto the enclosure 66 and may be oriented thereon as required to provide the desired lighting effect.

The lighting fixture of the present invention may be quickly and efficiently manufactured and assembled fabricating the stake, covers, and reflector assembly of stainless steel provides the instant lighting fixture with corrosion and temperature resistance. To provide electrical contact from the power cable to the lamp element, a portion of the power cable is formed into a tight loop and is placed into the channel formed in one of the lamp cores 34 or 36. The other lamp core then covers the loop. When the cores are brought together, as shown in FIG. 6, the spikes 42, 43 are pressed into the narrow sides of the rectangular power cable and contact with the conductors therein.

Preferably, the lamp cores 34, 36 which form the lamp holder 39 are enclosed within a lamp socket housing, i.e., covers 21 and 23 which are fitted together in a manner similar to the engagement of the cores. After the lamp cores 34, 36 are engaged around the power cable 18 (with the cores are preferably within a lamp socket housing), the lamp socket may be installed onto the ground stake with the screw 60. The lamp element may then be slideably engaged into the lamp socket and the reflector assembly 24 or 64 may be installed onto the lamp element 22.

A primary advantage of the present lighting fixture is the simplicity and reliability of the electrical engagement of the contacts 38 and 40 with the power cable within the lamp holder 39. As previously mentioned, the power cable has a generally rectangular cross section, and it has been discovered that the power cable has a much closer manufacturing tolerance on the dimension across the narrow or shorter sides of the rectangle, i.e., the narrow edges of the power cable are more precisely manufactured dimension-wise than are the wider edges. The instant lighting fixture takes advantage of this discovery by driving the spikes 42, 43 of the contacts into the edges of the power cable, rather than into the wider sides thereof. This configuration assures a reliable electrical contact between the spike and the power cable conductors due to the precisely dimensioned U-shaped passage 46 in the lamp cores 34, 36 forming the lamp holder 39, which causes the power cable to be aligned in relation to the spikes by the more uniform and precise surfaces of the cable.

Furthermore, by looping the power cable and driving the spikes into the narrow edges of the cable, the lamp cores 34 and 36 may be identical. As a result, the covers 21, 23 forming the lamp socket housing may correspondingly be identical. In addition, as the spread light reflector assembly 24 and the accent or directional assembly 64 are interchangeable on the basic lighting fixture, manufacturing costs are reduced and outdoor lighting configurations may be quickly and easily altered by exchanging reflector assemblies and/or changing the orientation of the lamp socket. Moreover, as the electrical connection from the power cable conductor to the contact pins of the lamp element is provided by a single (copper) conducting part, i.e. contacts 38 and 40, a very low electrical resistance path is provided from the cable conductors to the bulb.

Thus, a lighting fixture is disclosed which reliably and simply provides electrical contact between the power cable and the lamp element, while also providing an aesthetic appearance and low manufacturing costs. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A lighting fixture comprising:

a lamp socket having a generally U-shaped passage therein of rectangular cross section formed by two opposing wide and two opposing narrow interior surfaces of said socket;

a generally rectangular power cable disposed within said passage;

a first contact and a second contact disposed within said socket, said first contact including a spike protruding from one of said narrow sides into said passage, and said second contact including a spike protruding from the other narrow side thereof such that said spikes engage the opposite narrow sides of said power cable to make electrical contact therewith; and a lamp element engaged to said socket and in electrical connection with said contacts.

2. The lighting fixture of claim 1 wherein said lamp socket comprises two substantially identical lamp cores and means for releasably holding said lamp cores together about said power cable.

3. The lighting fixture of claim 2 wherein said means for releasably holding is a screw passing through said lamp holders.

4. The lighting fixture of claim 2 further comprising a lamp socket housing formed by two identical covers.

5. A lighting fixture comprising:

a ground stake having a channel-like cross section and a pair of spaced apart arms at one end thereof;

a lamp socket pivotally mounted on said stake between said arms, said lamp socket including a socket housing containing a lamp holder formed of two substantially identical semi-cylindrical lamp cores, each core having a rounded outer surface and a generally planer inner surface, a base, and a neck, with a generally U-shaped groove formed in the inner surface of said base, the inner surfaces of the lamp cores aligned and alongside each other such that the grooves in said cores are aligned and form a U-shaped passage through said lamp holder having a rectangular cross section;

a power cable of substantially rectangular cross section having opposing wide and narrow sides with a loop segment secured within the U-shaped passage;

a contact within each core extending from said neck thereof to the groove in said base thereof, each contact having a spike protruding into the groove of its respective core in a direction generally perpendicular to the inner surface thereof, such that with said cores aligned to form said lamp holder, said spikes protrude into the narrow sides of said cable to engage conductors within the cable;

a lamp element having contact pins slideably engageable over said neck of said lamp holder, with said contact pins connectable to said contacts; and a reflector assembly releasably attachable to said lamp element.

* * * * *